United States Patent [19]

Manico et al.

[11] Patent Number: 5,027,146

[45] Date of Patent: Jun. 25, 1991

[54] PROCESSING APPARATUS

[75] Inventors: Joseph A. Manico; Donald E. Birr, both of Rochester, N.Y.

[73] Assignee: Eastman Kodak Company, Rochester, N.Y.

[21] Appl. No.: 401,389

[22] Filed: Aug. 31, 1989

[51] Int. Cl.[5] ..... G03D 5/04

[52] U.S. Cl. ..... 354/299; 354/319; 354/325; 430/432

[58] Field of Search ..... 354/320, 321, 322, 324, 354/325, 319; 134/64 P, 122 P; 430/432; 226/170

[56] References Cited

U.S. PATENT DOCUMENTS

| | | | |
|---|---|---|---|
| 1,880,450 | 10/1932 | Hickman et al. | 354/319 |
| 2,404,138 | 7/1946 | Mayer | 354/325 |
| 3,589,261 | 6/1971 | Krikelis | 354/325 |
| 3,630,213 | 12/1971 | Bruno et al. | 134/84 R |
| 3,981,583 | 9/1976 | Tsuchida et al. | 354/325 |
| 4,534,635 | 8/1985 | Johnston et al. | 354/322 |
| 4,853,727 | 8/1989 | Ganzke et al. | 354/325 |

*Primary Examiner*—A. A. Mathews

*Attorney, Agent, or Firm*—Roger A. Fields

[57] ABSTRACT

Apparatus for processing light sensitive sheet or roll material includes a plurality of processing stations for applying solutions to the surface of the material. A movable endless web partially immersed in a wash tank has a portion of its path outside of the tank for transporting sheet material to be processed past the processing stations.

Means are provided for placing the sheet material on the web at one end of the path portion outside the tank and for removing the material at the other end of the path portion. The continuous circulation of the web through the wash tank removes any processing solutions and debris from the web.

Means are provided for periodically purging the processing stations with cleaning solution which is also removed in the wash tank.

17 Claims, 4 Drawing Sheets

PROCESSING APPARATUS

BACKGROUND OF THE INVENTION

1. Field of the Invention

This invention relates to apparatus and methods for processing light sensitive material and more specifically to apparatus and methods employing surface solution applicators.

2. Description of the Prior Art

Apparatus is known for processing light sensitive material such as film or paper sheets using surface applicators. However, in general, such apparatus have reliability problems and are not suitable for use on a commercial basis for processing large quantities of sheet material. Poor reliability stems from the difficulty of transporting the light sensitive material into contact with the various solutions without contamination and the difficulty of cleaning the transport system. This is a particular problem when working with unstable processing solutions which when combined form tar like substances and/or precipitates that are difficult to remove.

SUMMARY OF THE INVENTION

In accordance with the invention an endless web is movable along a predetermined path having one portion extending adjacent a plurality of processing stations for transporting light sensitive sheet material past the process stations to effect processing of the material. A second portion of the web path extends through a web washing station. Means are provided for moving the web to effect transport of the material past said processing stations and cleaning of the web at the washing station after removal of the material.

In the disclosed embodiment, the washing station takes the form of a wash tank and the second path portion extends through the tank to immerse the web in a wash solution. Alternatively the wash station may comprise one or more spray nozzles and/or one or more scrubbers to effect continuous cleaning of the web.

Means are provided for periodically purging the processing stations with cleaning solution which is also removed in the wash tank.

BRIEF DESCRIPTION OF THE DRAWINGS

Other objects and advantages will become apparent from the following description taken in connection with the attached drawing wherein.

DETAILED DESCRIPTION OF THE PREFERRED EMBODIMENT

Figure 1:
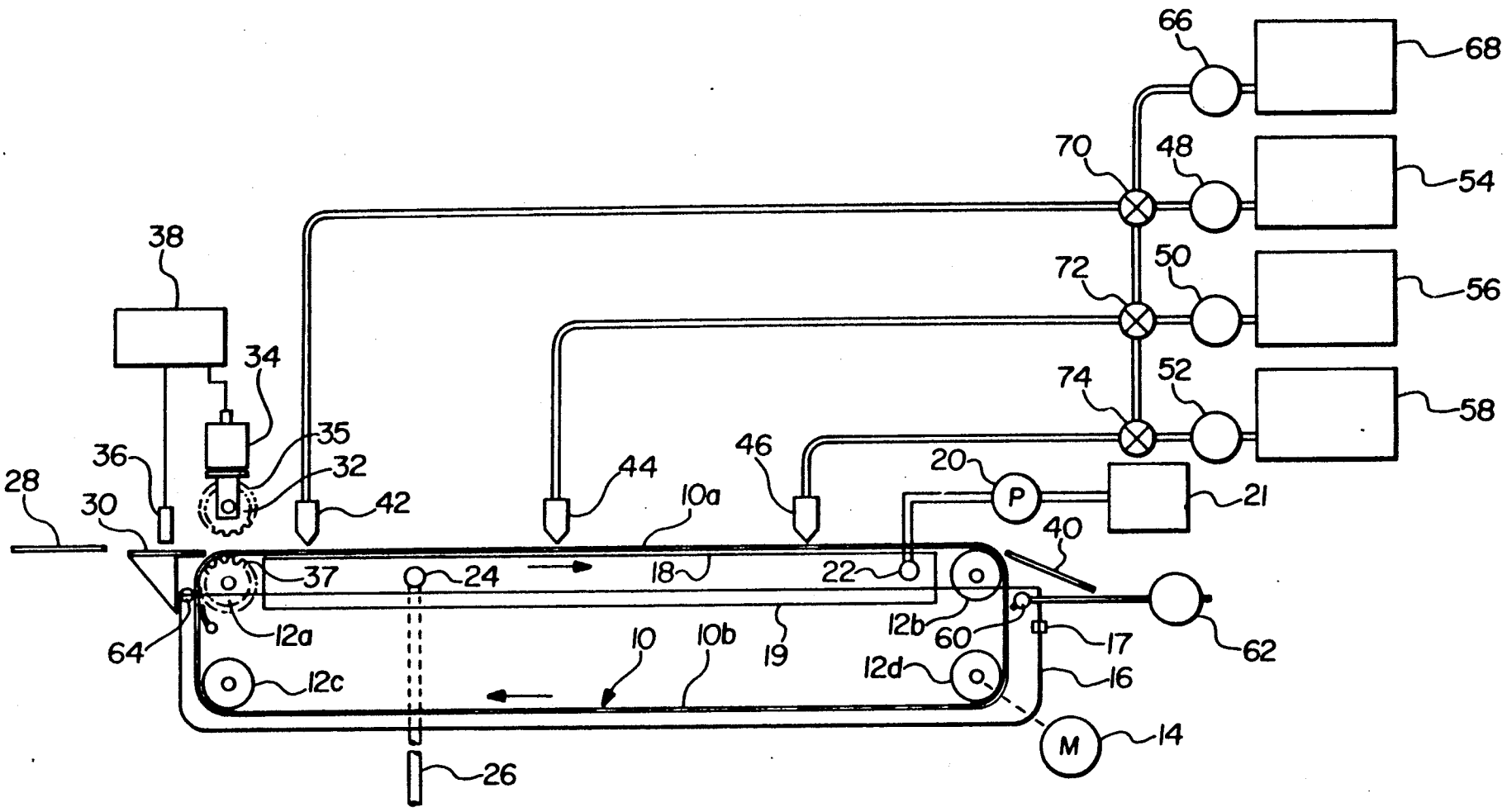
FIG. 1 is a schematic representation of a transport and processing apparatus in accordance with the invention.

The invention may be utilized in connection with the processing of various types of material e.g. sheets of light sensitive film or paper and continuous webs of such material. The disclosed embodiment has particular utility in processing sheets of light sensitive paper of the type commonly utilized to provide consumers with prints of images captured on photographic film. Accordingly the description will be directed to a sheet paper transport and processing appartus. Also, to simplify the disclosure only a simple 3 solution processor is disclosed. However, it will be apparent that the invention is applicable to more complex systems.

Referring to the drawings, a processing apparatus in accordance with the invention, comprises an endless flexible belt or web 10 which may be fabricated from MYLAR or other suitable material having a durable smooth surface that can be coated with water droplets. The web 10 is supported by four rollers 12 (*a, b, c, d*) in a generally rectangular configuration. One or more of the rollers 12 may be driven by a motor 14 as indicated schematically to effect transport of the web 10 clockwise as indicated by the arrows through the generally rectangular endless path established by the rollers 12.

The web 10 is movable through a path having a first portion or upper path segment 10*a* positioned adjacent a plurality of processing stations described below and a second portion 10*b* extending through a wash station. In the disclosed embodiment, the wash station comprises a tank 16 containing a washing solution such as water through which the path portion 10*b* extends. Alternatively, however, the wash station may comprise one or more sprayers and/or one or more scrubbers for continously cleaning the web.

Referring to the disclosed preferred embodiment the web and roller assembly is partially submerged in tank 16 which contains a washing solution such as water. The upper segment 10*a* of the web path remains above the solution level for transporting sheet material to be processed. The tank 16 is preferably filled with wash solution to the level of a level control drain 17. The portion 10*a* of the web path is positioned over a platen 18 positioned between the upper two rollers 12*a* and 12*b* and is used to transport sheet material past a plurality of process stations as described below. In the disclosed embodiment, the platen 18 comprises the upper surface of a flat hollow container 19 through which temperature controlled water is circulated by means of a pump 20 connected to a source 21 of temperature controlled water and to a water inlet 22 adjacent one end of the container 19. Water is discharged from an outlet 24 connected to a drain 26. With this arrangement, the platen 18 and transported sheets will be maintained at an optimum temperature for processing. Alternatively, the sheets being processed can be heated by infrared radiant energy. This can be accomplished by placing heater bars (not shown) in close proximity to the sheets being processed to heat the sheets as they pass under the bars. Another alternative is to place the entire web transport in an enclosed insulated housing and control the temperature within the housing with a heating/cooling unit and thermostat.

Figure 2:
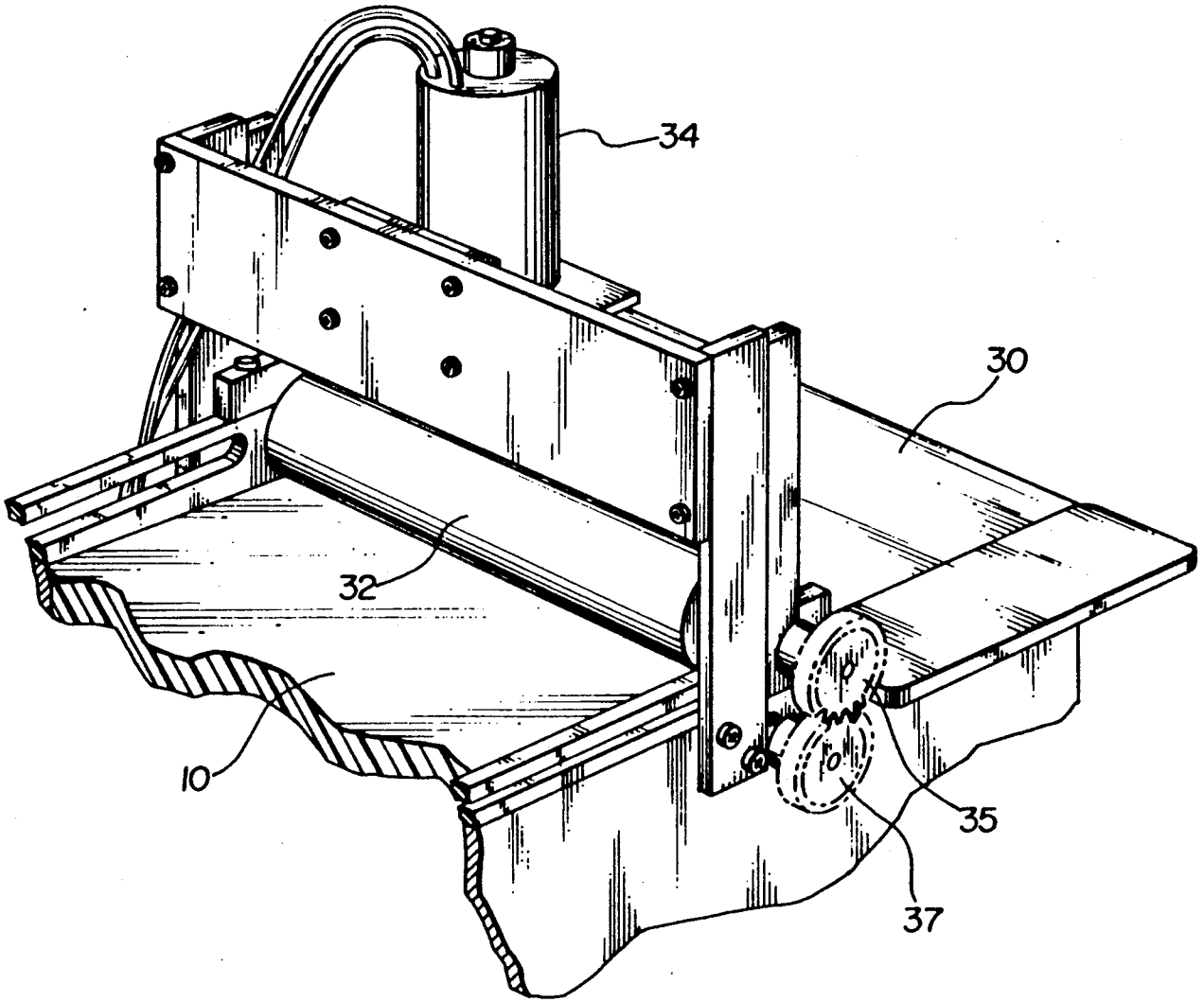
FIG. 2 is a perspective view showing in detail a portion of the apparatus shown in FIG. 1.

To accomplish processing a paper sheet 28 to be processed is placed on the web in segment 10*a* of the web path with its emulsion side up at a loading station comprising a plate 30 having one end positioned in close proximity to the web 10 at the left end of the platen 18. A sheet feeding roller 32 is positioned above the roller 12*a* and is arranged to be lowered by a solenoid 34 against the bias of a spring (not shown) into and out of engagement with the web 10. As shown most clearly, FIG. 2 gears 35 and 37 are fixed to the ends of the shafts of rollers 12*a* and 32. When the roller 32 is engaged with the web 10, gears 35 and 37 will mesh and roller 32 will be driven in sychronism with roller 12*a* to define a nip with the belt surface into which the end of a sheet on plate 30 can be fed. When inserted into the nip, the sheet will be grasped by the web 10 and roller 32 and transported onto the web 10.

It is desirable not to have the roller 32 in contact with the belt 10 when a sheet is not being fed into the processor to avoid absorption of wash solution by the roller 32 and transfer of the solution to the emulsion side of the sheets being processed. Accordingly, a sheet presense sensor comprising an infrared sensor 36 is positioned above the plate 30 to sense the presense of a sheet on plate 30. The sensor 36 is coupled to a controller 38 which will activate solenoid 34 in response to the presence of a sheet to lower the roller 32 into engagement with the web 10.

In addition to functioning as a sheet feeding device, the roller 32 functions as a pressure roller. Solenoid 34 is arranged to urge roller 32 into engagement with web 10 with sufficient pressure to effectively adhere the sheet 28 to the web 10 by wet lamination. After the sheet passes through the entrance nip, it will be held firmly in place on the web 10 by surface tension between the non-emulsion side of the sheet and the wet web 10.

The sheet 28 will move with web 10 until the web turns around the roller 12*b*. At this point, the change in direction of the web 10 breaks the surface tension lamination and the sheet 28 continues on along a horizontal path. A chute 40 may be arranged to receive the sheet 28 as it leaves the web 10. Alternatively a conveyor may be positioned to receive the paper sheets.

Referring now to the processing function, as the sheet 28 is transported across segment 10*a* of web path, it will move past in this case three Processing stations 42, 44 and 46 for applying developer, fix and rinse solutions respectively to the emulsion side of sheet 28. In the disclosed embodiment, the stations 42, 44 and 46 all comprise hopper applicators of a type well know to those skilled in the art. More specifically, each hopper comprises a chamber having a length at least equal to the maximum width of the sheet 28 being processed and having a thin liquid discharge slit in close proximity to the sheet on the web 10 and extending transversely to the web. Processing solutions are pumped into the hoppers by pumps 48, 50 and 52 connected to process solution storage tanks 54, 56 and 58 respectively to form thin uniform coatings on the sheet 28.

While the processing stations are disclosed as comprising hoppers, it will be apparent to those skilled in the art that various types of surface applicators can be used. For example, solutions can be applied using spray applicators, air brush applicators, applicators of the type used in ink jet printers, brush applicators and roller applicators.

After the paper sheet is separated or delaminated from the web 10, the web section which transported the sheet moves into the tank 16 where it becomes immersed in a wash solution such as water. A spray nozzle 60 connected to a pump 62 is used to spray wash solution on the web 10 to augment the removal of processing solution and any debris from the web. This is particularly desirable when using developer and accelerator solutions which when combined become unstable after a short period of time (5 minutes) and form tar-like substances.

Figure 3:
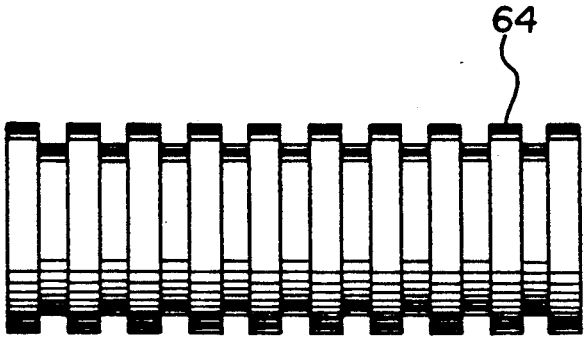
FIG. 3 is a top view of the squeegee roller shown in FIG. 1.
Figure 4:
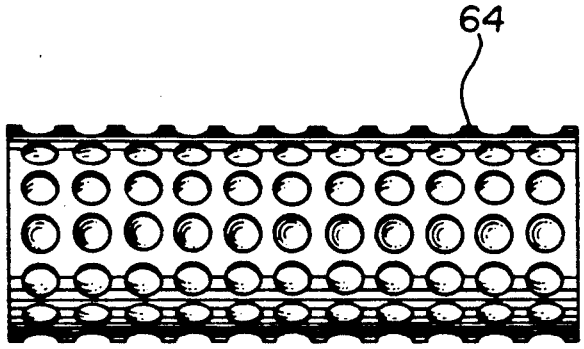
FIG. 4 is a view similar to FIG. 3 showing another embodiment of the squeegee roller.

As the web exits the wash tank 16, a patterned squeegee roller 64 removes water from the underside of the web. The squeegee roller 64 engages the outer surface of the web above the solution level to retain a controlled amount of moisture on the surface which receives the sheets to be processed. More specifically as shown in FIG. 3, the patterned squeegee roller preferrably comprises a roller with a series of indentations which produce an evenly patterned distribution of water droplets on the web. Alternatively the squeegee roller 64 may comprise a serrated squeegee roller as shown in FIG. 4. To enhance wetting of the web a wetting solution can be added to the wash solution to enhance web wetting.

Other web washing techniques can be employed. Instead of the spray wash an ultrasonic vibrator and/or a powered scrubber brush could be immersed in the wash tank to augment the removal processing solution and debris from the web.

To accomplish cleaning of the hoppers 44, 46 and associated plumbing means are provided for circulating a cleaning solution to purge the system. This means includes a pump 66 having its inlet connected to a cleaning solution storage tank 68 and its outlet connected to the inlet of each three, two way solenoid valves 70, 72 and 74. The other inlets of the valves 70, 72 and 74 are connected to the outlet of pumps 48, 50 and 52 respectively and the outlets of the valves are connected to the hoppers 42, 44 and 46. In their denergized state the valves 70, 72 and 74 connect the pumps 48, 50 and 52 to the hoppers 42, 44 and 46. However when energized they disconnect the pumps 48, 50 and 52 and connect the pump 66 to all three hoppers. Activation of the pump 66 in the energized state of the valves will thus purge the system with cleaning solution from the tank 68.

Figure 5:
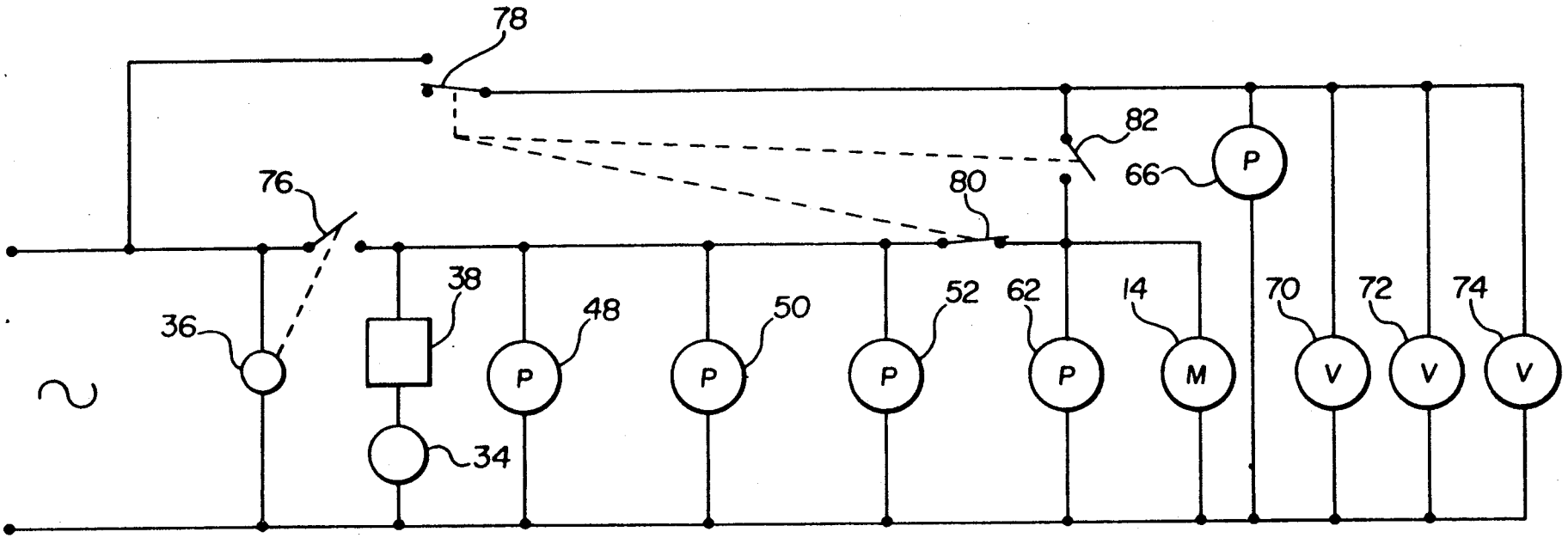
FIG. 5 is a schematic diagram illustrating a control system for the processing apparatus.

While various logic and control systems may be employed to control the system components an exemplary system is depicted in FIG. 5. In this arrangement the pumps 48, 50, 52, and 62 motor 14 and controller 38 and solenoid 34 are connected in parallel across a power source in series with a normally open switch 76 adapted to be closed by the sensor 36 when the presence of a sheet is sensed at loading station 30. With this arrangement, the solenoid 34 pumps 48, 50, 52, 62 and motor 14 will be activated to operate the system in a processing mode when the sensor 36 senses the presence of a sheet.

To provide for operation in a cleaning mode the valves 70, 72, 74, motor 14, pump 62 and pump 66 are connected in a second parallel circuit adapted to be coupled to the power source by a switch 78 which is open during the processing mode but closed during the cleaning mode. The switch 78 is mechanically coupled to a switch 80 which closed in the process mode but is open during the cleaning mode to prevent energization of the solenoid 34 and pumps 48, 50 and 52. A third switch 82 also adapted to be open during the processing mode is closed during the cleaning mode to effect energization of pump 62 and motor 14 along with pump 66 and valves 70, 72 and 74. It will be obvious to these skilled in the art that switches 78, 80, 82 can be activated simultaneously through appropriate mechanical couplings. Also the entire control system can be constructed using solid state components.

The advantages of the invention will now be apparent. During the processing mode, the tank 16 provides a simple reliable means for washing the web 10 and at the same time wetting the outer web surface to cause secure lamination of the incoming sheets to the web by surface tension. The lamination of the sheets to the wet web causes the sheets to be reliably transported past the processing stations 42, 44, 46 where solutions are sequentially applied to process the sheets without disturbing the emulsion side of the paper sheets. Roller 32 and web 10 cooperate to form a nip and thus means for feeding sheets into the processor. Sensor 36, controller 38 and solenoid 34 provides a means for preventing contact of the roller 32 with the wet web surface when a sheet is not being fed.

Because the web is continuously cleaned in the tank 16, minimal maintenance is required and chemical residue is prevented from contaminating the sheets being processed.

Another advantage of the disclosed processor is that it can be operated in a cleaning mode in which the surface applicators (in this case hoppers) and associated plumbing are automatically cleaned by purging with a cleaning solution which is discharged from the applicators onto the moving web when processing is not being performed. The purged solutions will then be removed in the wash tank.

The various parts thus cooperate to provide a reliable sheet transport and processing system using surface applicators to apply processing solutions.

The invention has been described in detail with particular reference to a presently preferred embodiment, but it will be understood that variations and modifications can be effected within the spirit and scope of the invention.

I claim:

1. Apparatus for processing light sensitive exposed material including a washing station and a plurality of processing stations, said apparatus comprising:

an endless web movable along a predetermined path having one portion adjacent said processing stations for transporting said material past said processing stations to effect processing of the material, said web having a second path portion ending through said washing station;

means for moving said web to effect transport of the material past said processing stations and cleaning of said web at said washing station; and temperature control means proximate said moving web for controlling the temperature of said material as it is transported past said processing stations.

2. Apparatus for processing light sensitive exposed sheets including a wash tank and a plurality of processing stations for applying solutions to the surface of the material, said apparatus comprising:

a movable endless web having at least one portion of its path immersed in said tank for washing said web and at least one portion outside said tank adjacent the processing stations for transporting sheets past said processing stations;

means for moving said web to effect transport of the sheets and the cleaning of said web in said wash tank; and temperature control means extending substantially adjacent said one portion of said web for making the temperature of the material uniform as the material is transported past said processing stations.

3. Apparatus as claimed in claim 2, further including a platen below said path portion outside of said tank, and means for heating said platen.

4. Apparatus as claimed in claim 2, further including roller means for feeding sheets onto said web and for pressure laminating said sheet material to said web by surface tension.

5. Apparatus as claimed in claim 4 further including means for controlling the amount of moisture on said web as it leaves the wash tank to augment said pressure laminating.

6. Apparatus as claimed in claim 5 wherein the path of said web has a rectangular configuration with two long portions and two short portions, one long portion being outside said tank and used to transport the sheet material.

7. Apparatus for processing light sensitive material including a wash tank and a plurality of processing stations for applying solutions to the surface of the material, said apparatus comprising:

a movable endless web having portions of its path immersed in said tank and one portion of its path outside of said tank which moves adjacent the processing stations;

means for placing the material to be processed on said web at one end of said one portion to transport the material past the processing stations;

means for removing the material at an other end of said one portion whereby said web enters the wash tank after the material is removed;

means located adjacent said wash tank for washing said web; and temperature control means extending substantially adjacent said one portion of said web for making the temperature of the material uniform as the material is transported past said processing stations.

8. Apparatus as claimed in claim 7, wherein said washing means comprises a pump and a spray nozzle connected to a source of washing solution to enhance said washing of said web.

9. Apparatus as claimed in claim 7 wherein said means for placing the material on said web comprises:

a support roller for supporting said one portion of said web;

a feed roller adapted to be positioned adjacent said web as it passes over said support roller to form a nip between said feed roller and said web;

means for disengaging said feed roller from said web when material is not being inserted;

a pair of shafts on which said feed roller and said support roller are respectively mounted; and a pair of gears respectively mounted on said shafts, said gears being adapted to mesh when said feed roller engages said web to drive said feed roller in synchronism with said support roller.

10. Apparatus as claimed in claim 9 wherein said disengaging means includes a sensor for sensing presence of the material adjacent said nip and control means including a solenoid for positioning said feed roller into engagement with the web when material is detected.

11. Apparatus for processing exposed light sensitive material including a plurality of process solution applicators, said apparatus comprising:

a washing station;

an endless web movable along a predetermined path having one path portion adjacent said applicators for transporting the material past said applicators, said web having a second path portion extending past said washing station;

first actuatable means for supplying processing solutions to said applicators;

second actuatable means for supplying a cleaning solution to said applicators;

third actuatable means for moving said web;

fourth actuatable means for loading material on said web;

fifth means for actuating said first means, said third and said fourth means to effect transport of the material past said applicators, application of processing solutions to the material and cleaning of the web at said washing station; and sixth means for actuating said second means and said third means to supply cleaning solution to said applicators and cleaning of said web at said washing station.

12. Apparatus as claimed in claim 11 wherein said washing station comprises a wash tank containing a washing solution and wherein a portion of the web path extends through said tank.

13. Apparatus as claimed in claim 12 further including a plurality of rollers supporting said web and wherein said loading means comprises a feed roller adapted to engage said web where it passes over one of said support rollers.

14. A method of processing light sensitive material which includes the steps of:

moving an endless web through a path a portion of which extends through a wash tank and a portion of which is outside the wash tank;

transporting material to be processed on the portion outside the wash tank past at least one processing station; and making the temperature of the material uniform as it is transported past the processing station.

15. A method of processing light sensitive material which includes the steps of:

moving an endless web through a path a portion of which extends through a wash solution and a portion of which is outside the solution;

placing material to be processed on one end of the portion outside the solution for movement by at least one processing station where the material is processed;

making the temperature of the material uniform as it is transported past the processing station; and removing the material from the web at the other end of the path portion outside the solution.

16. A method of processing light sensitive material which includes the steps of:

moving an endless web through a predetermined path;

placing material to be processed on one portion of the web for movement by at least one process solution applicator where the material is processed;

making the temperature of the material uniform as it is moved by the process solution applicator; and cleaning the web att a cleaning station.

17. A method as claimed in claim 16, further including the steps of passing a cleaning solution through the applicator onto the web; and removing the cleaning solution from the web at the web cleaning station.

* * * * *